United States Patent [19]

Zeyra

[11] 4,142,322

[45] Mar. 6, 1979

[54] UNITARY INFLATION DEVICES FOR HELIUM BALLOONS AND THEIR LIKE

[76] Inventor: Abraham Zeyra, 1512 S. Bedford St., Los Angeles, Calif. 90035

[21] Appl. No.: 735,458

[22] Filed: Oct. 26, 1976

Related U.S. Application Data

[63] Continuation-in-part of Ser. No. 644,742, Dec. 29, 1975, Pat. No. 4,034,501.

[51] Int. Cl.[2] ..... A63H 3/06

[52] U.S. Cl. ..... 46/90

[58] Field of Search ..... 46/87, 88, 89, 90; 137/231

[56] References Cited

U.S. PATENT DOCUMENTS

| | | | |
|---|---|---|---|
| 2,924,041 | 2/1960 | Jackson et al. | 46/90 |
| 3,429,330 | 2/1969 | Bogossian et al. | 46/90 |
| 3,871,422 | 3/1975 | Elson | 137/231 |

*Primary Examiner*—Louis G. Mancene
*Assistant Examiner*—Robert F. Cutting
*Attorney, Agent, or Firm*—Thomas Gunzler

[57] ABSTRACT

An inflation device adapted to admit compressed gas to the interior of a balloon, and to seal that interior against the atmosphere after inflation, is comprised of a pair of circular disks in parallel alignment and spaced from each other. The disks are rigidly affixed to a central shank which extends beyond one of them. The shank extension is bored with a passage, sealed at the far end thereof, in communication with the annular space between the disks by means of a radial orifice. The tubular neck of the balloon is stretched over the sealing disks, with the shank extension protruding from the opening of the balloon sheath. Upon pressurizing the passage in the shank with air, or other inflating medium, that portion of the balloon stretched between the two disks distends and permits the inflating medium to enter the internal volume of the gasbag around the periphery of the inner disk. The inflation device may be adapted to the inflation of multiple nested balloons by the addition of further sealing disks along the extended shank.

4 Claims, 12 Drawing Figures

UNITARY INFLATION DEVICES FOR HELIUM BALLOONS AND THEIR LIKE

This application is a continuation-in-part of my application 'Unitary inflation valves for helium balloons and their like' — Ser. No. 644,742 — filed on Dec. 29, 1975, now U.S. Pat. No. 4,034,501.

BACKGROUND OF THE INVENTION

The invention relates to an inflation device for balloons and other inflatable objects. It relates, more particularly, to inflation devices of unitary construction.

Toy balloons and similar extensible articles of rubber and plastic sheeting are commonly inflated by means of compressed gases — chiefly bottled helium — or by means of blowing air from the lungs into the interior volume defined by the continuous sheath of the article.

Once inflated, such articles tend to maintain their shape and function until the internal pressure is relieved, in time, through leakage. The main source of such leakage, and hence the greatest handicap to the longevity of the artifact, lies in the closure at the inflation nozzle. Quite often the opening through which the inflating gas had been admitted is simply tied off, either by making a knot in the material of the balloon itself, or by passing a string around the nozzle and pulling it tight in a knot. The latter method has the advantage that quite often, especially in the case of toy balloons, there is a requirement for a string by which the balloon may be held captive.

It is more common, especially when the inflation of the balloons, or other such artifacts, is undertaken as part of commercial activity that the process of filling the balloon and sealing the nozzle is undertaken via a one-way valve entrapped in the nozzle portion of the balloon. The primary requirements for such valves consist of lightness, a tight seal — both at the periphery of the valve and within the valve components themselves — and ease of insertion and operation.

Inflating valves of the prior art have been modeled on the non-return valves commonly encountered in the hydraulic arts and comprised a body and a separate valve element, either a movable plug or a resilient valve plate, which was movable with respect to a seat in the body.

Because of their two-part construction such valves of the prior art are both relatively heavy, difficult to manufacture, and expensive. Additional problems inherent in the two-piece construction involve a greatly increased probability of leakage, especially with respect to helium, the most commonly employed inflatant for toy balloons and other such artifacts which are intended to be lighter than the atmosphere, because of the tendency of helium to pass through the smallest passages and crevices. In fact, helium is the most commonly employed of fluids in the hydraulic arts for the detection of leaks and is widely used to test components which are meant to be hermetically sealed from their surroundings.

It is, therefore, the primary object of the invention to provide a unitary inflation device in which the flexible sheath of article to be inflated co-operates with a valve body to form the inflation passage and to seal the internal volume after inflation.

It is further object of the invention to provide such a unitary inflation device which is light in weight and simple in construction.

It is yet another object of the invention to provide such an inflation device which is adapted to be inflated by either bottled gases or by mouth.

It is also an object of the invention to teach constructional features in such inflation devices which particularly adapt them for use with automatic and semi-automatic inflation systems, as well as means for attaching strings when employed in toy balloons and the like.

It is an additional object of the invention to teach the construction of unitary inflation devices for inflatable articles which are economical to produce and easy to use.

It is also an object of the invention to describe unitary inflation devices particularly adapted to the simultaneous inflation of two or more nested balloons.

It is yet another object of the invention to teach the construction and use of support devices for toy balloons inflated with atmospheric air and particularly adapted to cooperate with the unitary inflation devices of the invention.

SUMMARY OF THE INVENTION

The foregoing objects of the invention — and other objects and advantages which will become apparent from the detailed description of the preferred embodiment thereof — are attained in a bobbin-like structure with two, or more, parallel disks interconnected by a central shank; with the shank extending past one of the end disks to form an inflating nozzle.

Balloons and their like are generally provided with an integral neck portion substantially tubular in shape and formed of the elastomeric material of the inflatable artifact. The inflation device of the invention is adapted to be slipped into, and to be gripped by, this tubular neck, with the parallel disks athwart the passage formed in that neck-like portion and with the extended shank of the inflation device protruding from the open end of the neck.

An air passage interconnects the outboard end of the shank with the space intermediate between two of the parallel disks. This passage runs as an internal bore through the shank and terminates in at least one orifice passing through the wall of the shank, substantially parallel to the planes of the disks.

Air blown into the open end of the shank — the opposing end being plugged or sealed — is forced into the space between two disks, the outer periphery of which is sealingly encompassed by the stretched neck of the balloon.

The pressure exerted onto the cylindrical portion of the neck causes the latter to distend into a convex configuration and to unseal the inner disk and to permit the flow of compressed gas from the space between the transverse seal disks into the main volume of the balloon.

To keep the sheath off the disk, a pressure differential must exist between the gas source and the balloon volume. As soon as the driving pressure approaches the inflation pressure of the article, the inherent resilience of the skin over the valve perimeter causes the latter to contract and to reestablish a sealed relationship between the inside of the inflated artifact and the external atmosphere.

To serve the purposes of toy balloons made buoyant by helium and unitary inflation device of the invention must be light and is therefore constructed, in its preferred forms, of lightweight plastic materials, low density polyethylene being a suitable material. The innermost disk of the valve is generally made somewhat smaller in diameter than the outward disk, or disks, and may be provided with a sharpened edge to establish a tight seal.

The inflation device may be readily adapted to inflating multiple balloons, nested one within the other, by the provision of additional sealing disks — two disks commonly sufficing for a single balloon — and stretching the innermost balloon's nozzle over the first two disks, and the nozzles of the next balloon in the nest over the next disk, and proceeding in the same manner until all the balloons in the assembly have been drawn over the valve body.

The integral shank of the inflation device is readily utilized to anchor strings or lines restraining buoyant balloons from escaping and support devices for balloons filled with atmospheric air or other non-buoyant media.

While the inflation device of the invention is described as unitary — and is preferentially made as a one-piece item — it may be assembled out of several parts; such part forming; upon assembly, a rigid whole with no moving or variable portions.

The shank of the inflation device may be formed into a mouthpiece, to facilitate oral inflation, or may be adapted to the various nozzles integral to commercial inflating systems commonly used in the art of preparing balloons and their like for sale or use.

BRIEF DESCRIPTION OF THE ACCOMPANYING DRAWINGS

The preferred embodiment of the unitary inflation device of the invention will be described in detail with reference to the accompanying drawings, wherein.

DESCRIPTION OF THE PREFERRED EMBODIMENT

Figure 1:
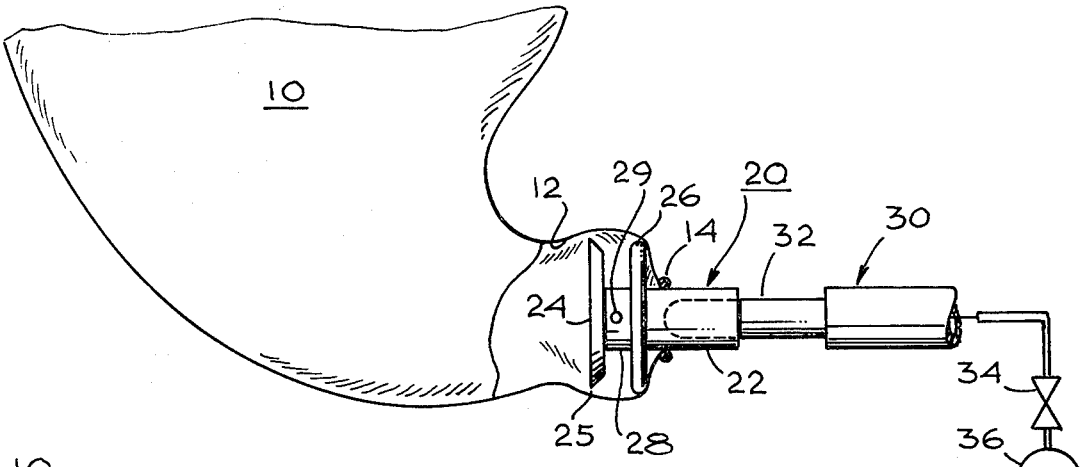
FIG. 1 is a transverse section through the neck portion of an inflated balloon, exposing a unitary inflation device of the invention with the charging nozzle of a compressed-gas charging system inserted into the nozzle of the inflation device.

The partially sectioned view of FIG. 1 shows a tranverse elevation of a toy balloon 10 with a unitary inflation device 20 inserted into a tubular nozzle 12 integral with the balloon.

The major elements of the inflation device 20 include a cylindrical stem 22 and a pair of sealing disks, an inner disk 24 at the far end of the stem 22 and an outer disk 26 spaced from the disk 24. An orifice 29 meets a blind bore running inside the stem 22 and emerges in portion 28 of the stem intermediate between the two sealing disks.

The unitary inflation device 20 is manufactured as a separate item, suitably being molded from low-density polyethylene or a similar plastic composition, from the balloon and inserted into the neck 12 in such a manner that the sealing disks 24 and 26 lie at right angles to the axis of the neck and inward of the reinforcing seam 14 at the opening thereof, with the seam 14 overlapping the outer surface of the seal disk 26.

The aforementioned blind bore inside the stem 22 is so sized that it will readily receive a nozzle 32 of an inflating machine 30. The inflating machine — known in the art and forming no part of the instant invention — also includes a container 36 of compressed gas, suitably helium, an on-off valve 34 and pressure regulating means not specifically illustrated.

FIG. 1 shows the nozzle 32 penetrating the stem 22, as required for the inflation of the balloon 10 with the aid of the inflating machine 30. The admission of compressed gas into the blind bore of the stem 22 would permit the gas to enter the annular space between seal disks 24 and 26, through orifice 29, and distend that portion of the balloon neck 12 which is stretched thereover. Such distention of the tubular neck segments tends to relieve the seal formed at the peripheries of the two seal disks. Because of the greater tenacity of the seal at the outer disk, reinforced as it is by the overlapping neck seam 14, the material of the balloon lifts first from the inner disk 24 and admits the pressurizing gas to the interior of the balloon.

In the inflation device 20 the two seal disks are of the same overall diameter but the peripheral edges are developed in slightly differing forms. The edge of the disk 26 is substantially of a semi-circular, smooth contour, while that of the inner disk 24 is sharpened into a circumferential edge 25, with the chamfer forming that edge towards the space enclosed by the two disks.

Figure 2:
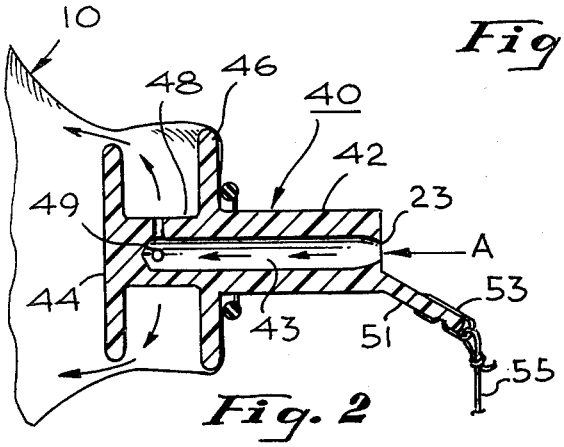
FIG. 2 is a section through another embodiment of the inflating device of the invention, showing the flow paths therethrough.

The transversely sectioned view of FIG. 2 shows an inflation device 40 similar to the inflation device 20 but differing in some constructional details from the embodiment shown in FIG. 1. The inflation device 40 is provided with a stem 42 and seal disks 44 and 46; the stem 42 is pierced by a channel 43 whose entrance 23 is somewhat smaller in diameter than the main run of the channel and gradually enlarges inward from the entrance. This configuration of the blind channel 43 is particularly adapted to form a firm seal around some of the commercially used inflating nozzles. The outer disk 46 separates the stem 42 from its continuation 48 intermediate between the seal disks. A number of radial orifices 49 in the stem portion 48 interconnect the annulus formed by the disks with the channel 43. The inner disk 44 terminates the valve assembly and its material seals the channel 43 from the interior of the balloon 10, which is draped over the inflation device 40 in the same manner as described with reference to the inflation device 20.

The disk 44 is somewhat smaller in diameter than the outer disk 46, to assist in the preferential lifting of the balloon material upon the admission of pressurized gas into channel 43. Arrows "A" in FIG. 2 show the path followed by the inflating medium through orifices 49 and past the outer edge of disk 44.

Figure 3:
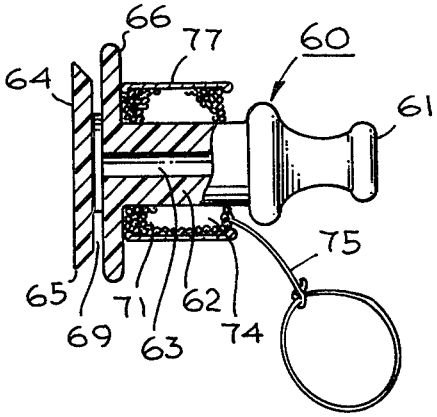
FIG. 3 is a partial transverse section through yet another embodiment of the unitary inflation device, with the shank thereof formed into a nozzle particularly adapted to oral inflation.

FIG. 3 shows an inflation device 60 with close-coupled sealing disks 64 and 66 expanding from a shank 62 which is formed into a mouthpiece 61 at the end farthest from the sealing disks.

An internal bore 63 extends from the mouthpiece 61 toward the inner disk 64 and communicates with the narrow annulus between the two disks through coaxial orifices 69 passing through a diameter of the stem 62. The inner disk 64 is slightly smaller in diameter than the outer disk 66 and its perimeter is chamfered into a sharp edge 64, in contrast to the smooth contour of the latter.

Figure 4:
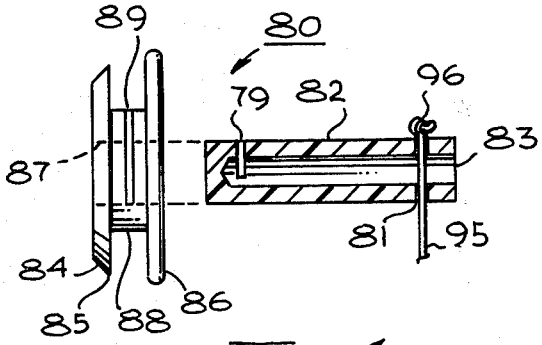
FIG. 4 is a partially sectioned, exploded view of an inflating nozzle constructed from two component parts.

FIG. 4 shows an exploded view of an inflation device assembly 80 with a separate shank 82 assembled into a bore 87 in the main valve body by means of an interference fit. The inflation device body is formed of a central boss 88 flanked at either side by seal disks 84 and 86. The inner seal disk 84 is chamfered into a sharp edge 85 with the larger diameter of the chamfer toward the outer disk 86. The boss 88 is partially severed by a sawkerf 89 intercepting the central bore 87.

The shank 82 is penetrated by a blind bore 83 and a lateral groove, or sawkerf, 79 which, upon assembly of the two components of the valve insert 80, becomes coplanar with the kerf 89 and forms an interconnecting passage by way of which compressed gas may pass through the bore 83 into the annular space defined by the disks 84 and 86.

The illustrations of FIGS. 1 through 4 showed four embodiments of the basic form of the unitary inflation device of the invention. While differing in constructional details all four of the inflation devices shown exhibit the same basic structure including paired, parallel seal disks of circular outline, a stem, or shank, protruding to the outside of the balloon neck and providing gas passages interconnecting the outside atmosphere, or the source of inflation pressure, with the space between the seal disks, and, in inflation devices 40, 60 and 80, means for attaching anchor strings to the inflation device bodies.

The provision of such attachments for strings is a common requirement in toy balloons, which represent the largest class of inflatable artifacts of the type for which the inflation device of the invention is most suited.

The attachment of strings may take several forms. In inflation device 40 an integral tongue 51 extends from the end of stem 42 and is gripped by a staple 53 in such a manner that one end of the staple forms an eye suitable to have a string 55 threaded therethrough and fastened by means of a knot.

In the inflation device 60 the string is attached to the base of the stem 62 by a blob of glue 71, and the shank of the stem is utilized as a bobbin to wind the string for storage. The wound string body 74 is securely retained, until extended for use, by means of a rubber band, or sleeve, 77 which leaves the free end of the string readily accessible by the user.

In the embodiment of FIG. 4, a string 95 is simply passed through a diametral orifice 81 through the stem 82, and retained by means of an enlarging knot 96.

The several forms of the inflation device exhibit certain characteristics of some importance in their commercial distribution. The major advantage connected with the manner of construction is the ease with which the inflation device may be adapted to balloons and other inflatable bodies of a given size, neck diameter and skin flexibility. The adjustment is made by varying the diameter of the seal disks, their relative sizes and the shape of the sealing lip of the inner of the two seal disks.

Another feature of import in some applications lies in the ability of the unitary inflation device to prevent overinflation of balloons. Some balloon materials may be readily stretched to a point where their service life becomes appreciably shortened; suitably configuring the sealing edge of the inner disk will permit the excess gas pressure to leak back out of the balloon upon the removal of the inflating nozzle, re-establishing the seal when the designed pressure differential between the gasbag and the atmosphere is reached.

A further feature of the inflation device lies in tunability of the acoustics of the source chamber between the disks and the edge of the inner seal disk, defining a flow passage bounded by an elastic membrane externally. Attractive and melodious whistling sounds may be produced upon the inflation of balloons which may be a considerable advantage in attracting customers to the point of inflation and sale.

The greatest advantage, of course, of the unitary design lies in the light weight of the inflation device body, which permits the use of inflation devices with relatively small balloons and inflating toys without impairing their buoyancy — when filled with helium — in atmospheric air.

A further advantage of the inflation device lies in its ability to provide for better sealing, where exceptional leak tightness is required by providing additional seal disks, inboard of the inner disk of the previously described two-disk configuration of the inflation device. While these additional sealing surfaces provide additional resistance to inflation, and may in some cases require specially constructed balloons with extended necks to accommodate the greater bulk of the multi-disk inflation system, they also provide commensurately better sealing.

Figure 5:
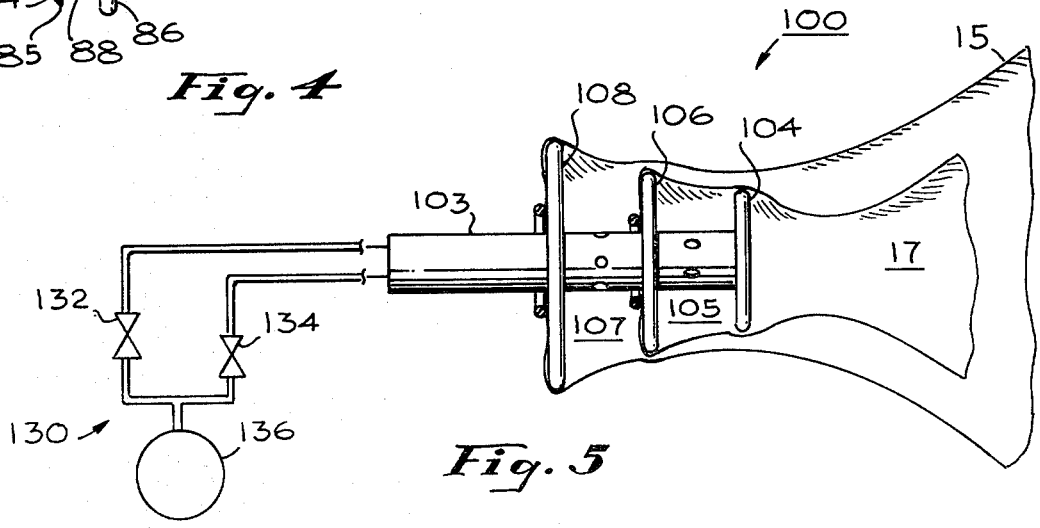
FIG. 5 is a partially sectioned view of a dual toy balloon with a valve-forming insert particularly adapted to simultaneously inflate both balloons and to control the pressure differential therebetween.

Another use of multiple disk inflation devices is illustrated in FIG. 5 where an inflation device 100 is shown inserted into coaxial balloons 15 and 17. Such multiple balloons have attained considerable popularity in recent times and generally consist of a relatively fragile inner balloon shaped and colored to resemble a cartoon character or other pictorial object. The outer balloon is a transparent bubble completely encompassing the figure of the inner one and protecting it from damage.

Such double balloons present considerable difficulties in inflation with valves of the prior art. Not only that there are two balloons to inflate, preferably simultaneously, but a pressure differential must be established between them, so that a slightly higher internal pressure can keep the inner balloon fully inflated inside the larger one.

The inflation device 100 incorporates a shank 103 upon which three, substantially equispaced, disks 104, 106 and 108 are molded. The three disks define two intervening annular volumes, a volume 105 between sealing disks 104 and 106, and another volume 107 between disks 106 and 108. These volumes communicate via orifices piercing the shank 103 with two adjacent channels running inside the shank. One channel feeds inflating gas into the volume 105, while the other supplies the volume 107.

A special charging system 130 incorporates a source 136 of compressed inflating medium and two separate pressure control systems, represented schematically by valves 132 and 134, which ensure that the medium admitted into volume 105 is always at a slightly higher pressure level than that admitted to the volume 107.

The sheath of the inner balloon 17 is passed over the seal disks 104 and 106, in a manner analogous to the assembly of the balloon 10 to the inflation device 20, for example. Gas from the pressurized volume 105 enters the interior of balloon 17 by passing over the edge of the seal disk 104.

The sheath of the outer balloon 15 is stretched over all three sealing disks and draped over the outboard flank of the outermost disk 108. The balloon 15 is pressurized from the volume 107 by gas passing between the sheath of balloon 17 — stretched upon the edge of disk 106 — and the distended neck portion of the outer balloon.

The innermost seal disk 104 is slightly smaller than the intermediate disk 106 in diameter, to facilitate the preferential lifting of the seal during inflation; the outermost disk 108 is yet larger in diameter than the disk 106, partly for the same reason and partly to compensate for the double thickness of balloon material over the edge of the intermediate seal plate.

Figure 6:
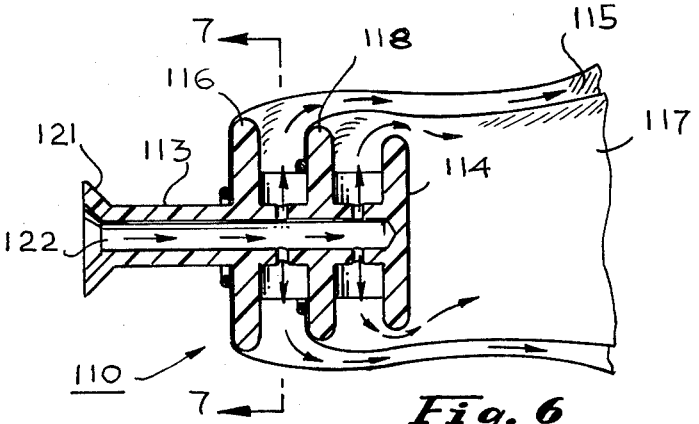
FIG. 6 is a sectional view analogous to FIG. 5, showing an inflation device adapted to simultaneously inflate two nested balloons from a single source of inflating medium.

The embodiment shown in FIG. 6 is very similar to that of FIG. 5 and the inflation device 110 is intended for the simultaneous inflation of a pair of nested balloons. The device 110 is provided with a cylindrical shank 113 with an air passage 122 passing through the center of the shank. The outboard end of the shank is flared to form an entry portion 121 equally adapted to serving as a mouthpiece and as an insertion guide for an inflating nozzle.

The shank 113 terminates in a seal disk 116 and continues, in the form of an air-distribution member 103 toward seal disks 118 and 114 approximately equispaced along the member 103. Radial orifices interconnect the air passage 122 with the annular spaces defined by the three disks. The neck portions of balloons 115 and 117 are stretched over the three seal disks in a manner identical to that shown in FIG. 5. Inflating gas is passed into the balloons by pressurizing the passage 122, the sizes of the radial orifices being so chosen that the required pressure differential between balloons 117 and 115 is automatically maintained.

To attain the desired flow distribution — the parallel flow paths into the two balloons being indicated in FIG. 6 by arrows — it is generally required that the orifices terminating in the annular space between disks 116 and 118 be made smaller than those issuing between disks 118 and 114. The additional restriction represented by the smaller orifice flow areas ensure that the pressure of inflatant reaching the interior of balloon 117 is higher than the pressure upon entry into the balloon 115.

Figure 7:
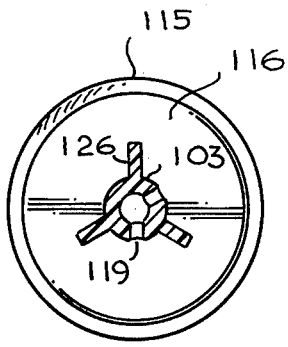
FIG. 7 is a transverse section through the embodiment of FIG. 6, illustrating the use of reinforcing ribs between adjacent sealing disks.

The transverse section of FIG. 7 is taken along section line 7—7 of FIG. 6 and illustrates the use and disposition of three reinforcing ribs 126 which issue radially from the shank extension 103 and interconnect the three sealing disks 116, 118 and 114. The reinforcing ribs 126 impart additional mechanical strength to the inflation device at a relatively low cost in additional material and, more significantly, weight. A typical orifice 119 communicating with the blind bore 122 and the annular space between seal disks 116 and 118 is also shown.

Figure 8:
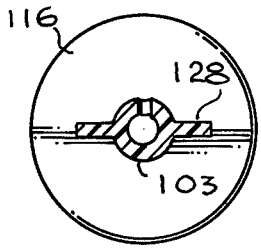
FIG. 8 is a transverse view of an inflation device incorporating two reinforcing ribs.

FIG. 8 is a transverse section through another embodiment of the inflation device utilizing a pair of reinforcing ribs 128 serving the same purpose as the reinforcing ribs 126 of FIG. 7.

Figure 9:
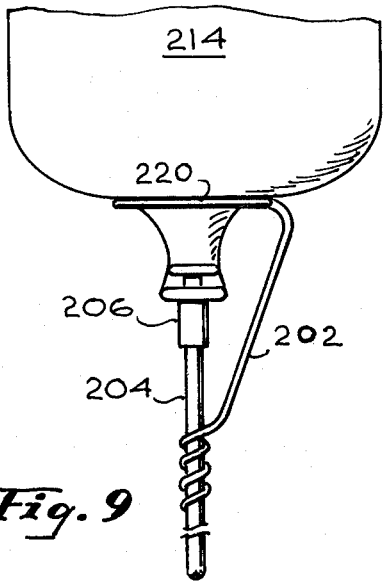
FIG. 9 is a side elevation of an inflated toy balloon equipped with an inflation device of the invention and supported on an elongated handle attached to the inflation device insert and, additionally, employing a balloon support member.

FIG. 9 is a partial side elevation of a balloon 214 pressurized with atmospheric air via an inflation device insert 206 of the invention. Balloons inflated with air are not buoyant in the earth's atmosphere and must be supported in some fashion against dropping to the ground, suitably by means of a rigid rod or stick 204 inserted into the air passage of the inflation device 206.

While the use of the support rod 204 does permit the holding of the balloon 214, it cannot prevent the sagging of the balloon with respect to the rod and inflation device assembly. An additional support member 202 is, therefore, provided to encompass the expanding neck of the balloon with a ring 220 and to maintain the balloon in proper alignment relative to the rod 204.

Figure 10:
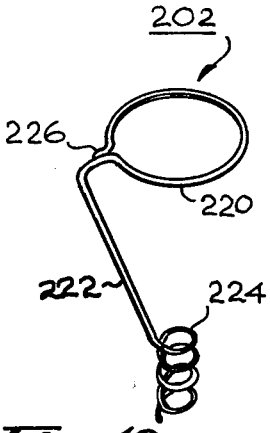
FIG. 10 is a perspective view of the balloon support member employed in the embodiment of FIG. 9.

The support member 202 is constructed of a single length of rigid wire — suitably of mild steel, aluminum, or other metallic alloy — and is shown in the perspective view of FIG. 10. The ring 220 is made smooth by bending the wire into a radially directed portion 226 at one end; the other end is bent outward and down to form a strut 222. The strut 222 is angled inwardly so that a spiral, coil-spring like termination 224 at the lower end thereof is centered with respect to the ring 220 and runs axially in direction, orthogonal to the plane defined by the ring.

The coil 224 is sized to be a tight fit around the rod 204 and to transmit the forces necessary to support the balloon 214 in a coaxial alignment above the rod.

The use of support member 202 allows a balloon inflated with atmospheric air to be carried and displayed in a manner analogous to a buoyant balloon filled with helium or other lightweight inflatant. The use of rod 204 and support 202 with an inflation device 206 of the invention is particularly apt, due to the presence of a cylindrical channel in the shank of the device 206, or its equivalents, ensuring a coaxial and secure retention of the rod 204 therein.

Figure 11:
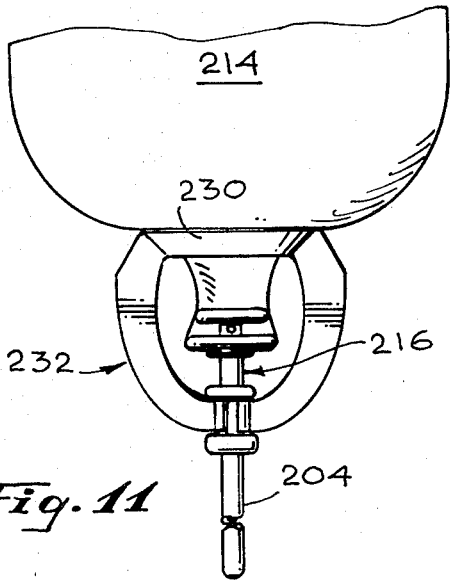
FIG. 11 is another embodiment of the balloon support device used in conjunction with the inflation nozzle insert of the invention.

FIG. 11 is another elevation view of the balloon 214 equipped with an inflation device insert 216 particularly adapted to receive, and co-operate with, a support device 232. The balloon 214 is supported by a conically expanding ring 230 integral with the support member 232; the combined assembly of balloon, inflation device and support member being held upright by the rod 204, secured into the air passage at the insert 216.

Figure 12:
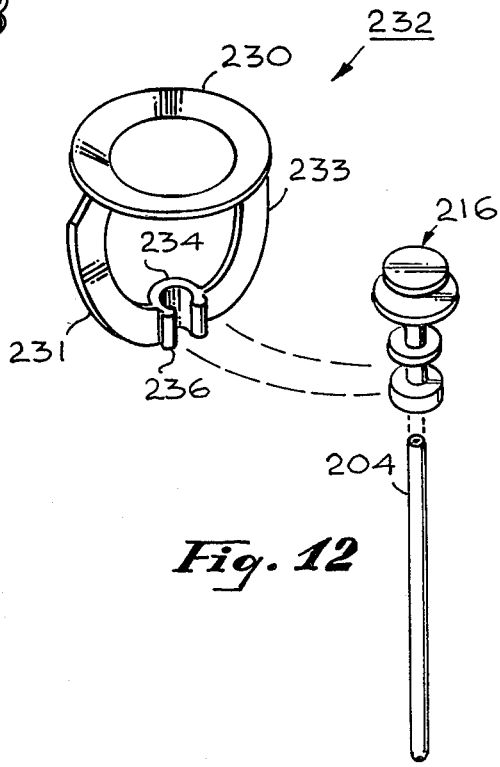
FIG. 12 is an exploded perspective view of the components of the assembly of FIG. 11, omitting the balloon for the sake of clarity of illustration.

An exploded isometric view of the mechanical components of the assembly of FIG. 11 is provided in FIG. 12; the balloon 214 being omitted from the latter illustration for the sake of clarity of presentation. The inflation device insert 216 is similar to the device 206, with the exception of the provision of a pair of spaced collars along the shank of the device. The support member 232 engages the portion of the shank intermediate between the collars by means of an elastic, partly open sleeve 234. The edges 236 of the open sleeve are rounded for reinforcement and to provide cams for spreading the sleeve while being installed onto the shank of inflation device 216. Supporting ribs 231 and 233 are affixed to the outside of the sleeve 234 and interconnect the sleeve with the ring 230.

The ribs 231 and 233 provide the mechanical support for the ring 230 which enables the latter to maintain the balloon 214 in an upright alignment with respect to the rod 204. The ribs also align the sleeve 234 centrally under the ring 230. The support member 232 is particularly adapted to manufacture by the process known as injection molding, utilizing a rigid plastic composition as the structural material. Such construction allows for the required physical strength, as well as for the flexibility of the sleeve 234 which acts as a spring in gripping the shank of the inflation device 216.

While the invention has been described above with particular emphasis on forms and embodiments suited to the inflation and sealing of toy balloons and their cognates in the field of inflatable toys it is to be understood that other forms and uses shall also be deemed to be encompassed by the inflation device of the invention which is delimited only by the appended claims.

In particular, the described embodiments have been generally suited to machining and/or molding from lightweight plastic compositions, have been provided with a plurality — generally two — of sealing disks of circular form, and incorporated means for securing anchor strings. Other forms of the invention may be suited to the inflation and sealing of air mattresses, inflatable furniture and other self-supporting structures and may provide inflation devices manufactured from high-density plastics and from metals and be provided with sealing disks whose outline is particularly adapted to fit the shapes of the inflating nozzles thereof, oval or rectangular, for example.

I claim:

1. As an article of commerce, the combination of an inflatable balloon, an inflation device provided with a cylindrical inflation channel coaxial with the inflated balloon when installed in the inflating nozzle integral with said balloon, an elongated rigid manipulating rod, frictionally engaged in said inflation channel, and a support member, wherein said support member comprises:

a support ring for said balloon;

anchor means adapted to frictionally engage a portion of said manipulating rod; and rib means interconnecting said anchor means with said support ring.

2. As an article of commerce, the combination of an inflatable balloon, an inflation device provided with a cylindrical inflation channel coaxial with the inflated balloon when installed in the inflating nozzle integral with said balloon, an elongated rigid manipulating rod, frictionally engaged in said inflation channel, and a support member, wherein said support member comprises;

a support ring for said balloon;

anchor means adapted to frictionally engage a portion of said inflation device; and rib means interconnecting said anchor means with said support ring.

3. A one-piece inflation device, comprising:

an elongated, tubular shank with a cylindrical bore open to one end thereof and closed at the other end;

three circular, planar sealing disks, rigidly affixed to said tubular shank and projecting therefrom at right angles in a parallel spaced array, with an innermost of said sealing disks proximate to said other end of the tubular shank, constructed with diametral dimensions progressively increasing along said array, away from said innermost sealing disk; and orifice means diametrally piercing said tubular shank between at least one pair of sealing disks in said array wherein said oriface means pierces said tubular shank to communicate with each of the two annular spaces formed between each pair of said three sealing disks.

4. The device of claim 3, additionally comprising reinforcing means, including a plurality of radially extending ribs integral with said tubular shank between at least one pair of sealing disks in said array.

* * * * *